US006729078B2

(12) United States Patent
Vrhel

(10) Patent No.: US 6,729,078 B2
(45) Date of Patent: May 4, 2004

(54) TOMBSTONE REPAIR FRAME

(76) Inventor: James Richard Vrhel, 7520 Kingston Dr., Portage, MI (US) 49002

( * ) Notice: Subject to any disclaimer, the term of this patent is extended or adjusted under 35 U.S.C. 154(b) by 119 days.

(21) Appl. No.: 10/232,071

(22) Filed: Aug. 30, 2002

(65) Prior Publication Data

US 2004/0040246 A1 Mar. 4, 2004

(51) Int. Cl.[7] ..... E01F 9/011
(52) U.S. Cl. ..... 52/103; 52/155; 52/514; 40/124.5
(58) Field of Search ..... 52/103, 155, 514; 40/124.5

(56) References Cited

U.S. PATENT DOCUMENTS 3,650,072 A 3/1972 Matvey
3,758,999 A 9/1973 Matvey
4,452,013 A * 6/1984 Nagata ..... 49/344
D388,226 S 12/1997 Giosa
D395,124 S 6/1998 Warren
5,845,436 A 12/1998 Nota
6,173,539 B1 1/2001 Barnes
6,341,437 B1 1/2002 Heiling et al.
6,363,635 B1 4/2002 England

* cited by examiner

*Primary Examiner*—Carl D. Friedman
*Assistant Examiner*—Steve Varner
(74) *Attorney, Agent, or Firm*—Joseph K. Andonian

(57) ABSTRACT

A frame designed to hold worn or broken historical tombstones together indefinitely. The preferred stainless steel frame includes an integrated back panel on which the original inscription is engraved, thereby preserving the original inscription that may have faded due to age and weather to the point of illegibility.

14 Claims, 3 Drawing Sheets

TOMBSTONE REPAIR FRAME

BACKGROUND OF THE INVENTION

Tombstones tend to deteriorate over the ravages of time or vandalism leading to breakage and unreadable inscriptions. However there is little or no recognition in the published art known to the inventor for methods or products suitable for repairing such old or historical tombstones. The term "historical tombstones" is used in this specification to refer to generally old, sometimes broken tombstones that have deteriorated from age, weathering and/or vandalism and which would benefit by use of the present invention.

SUMMARY OF THE INVENTION

An object of the present invention is to provide a frame and a method for repairing and preserving historical tombstones that are often broken due to the wear and tear of age, weather, or vandalism. These tombstones are usually not replaced due to the high cost of replacement stones or the historical value of their aged condition. As time passes an increasing number of these broken stones litter our nation's cemeteries. This invention provides a method of addressing this problem at a reasonable cost. Another object of this invention is to provide a method of preserving the inscriptions on these historical tombstones, which may have become illegible from the wear and tear of time and weather.

These objectives are achieved in the present invention through the introduction of a stainless steel frame that encloses the sometimes broken pieces of these tombstones and holds them together. This stainless steel frame comprises a cap that encloses the top and sides of the tombstone and an integrated back panel where the original inscription is engraved, thereby preserving both the original tombstone and its inscription for future generations, who sometimes try to paper trace the old tombstones and find they are too weathered to trace. Stainless steel keeper plates that hook below ground level under the solid, usually concrete base on which the tombstone sits complete the frame. Thus the stainless steel frame is made a permanent part of the original tombstone that won't rust away over time. Once installed with the keeper plates screwed into place and a layer of silicone between the tombstone and the stainless steel frame, to protect the stone from expansion and contraction, the frame is virtually permanent.

Although stainless steel is preferred for making the frame because of its ready availability, low cost, long life, and appearance, anodized aluminum, brass, bronze and even plastic could be substituted with generally lesser acceptability. Likewise although it is preferred to enclose the tombstone in the manner described herein, it is only necessary to wrap the frame around the top, left and right side edges of the tombstone with sufficient overlap to secure the frame to the tombstone and tie the intact or parts of the tombstone to the base with sufficient strength and durability to prevent future deterioration, breakage or separation. Further, although silicone is the preferred adhesive to reassemble the broken pieces of the tombstone or provide a cushion between the stone and the frame, any other long lasting adhesive compatible with stone and the frame would be suitable.

BRIEF DESCRIPTION OF THE DRAWINGS

The invention will be better understood when consideration is given to the following drawings in which the tombstone and its base are shaded.

LIST OF REFERENCE NUMERALS

Figure 1:
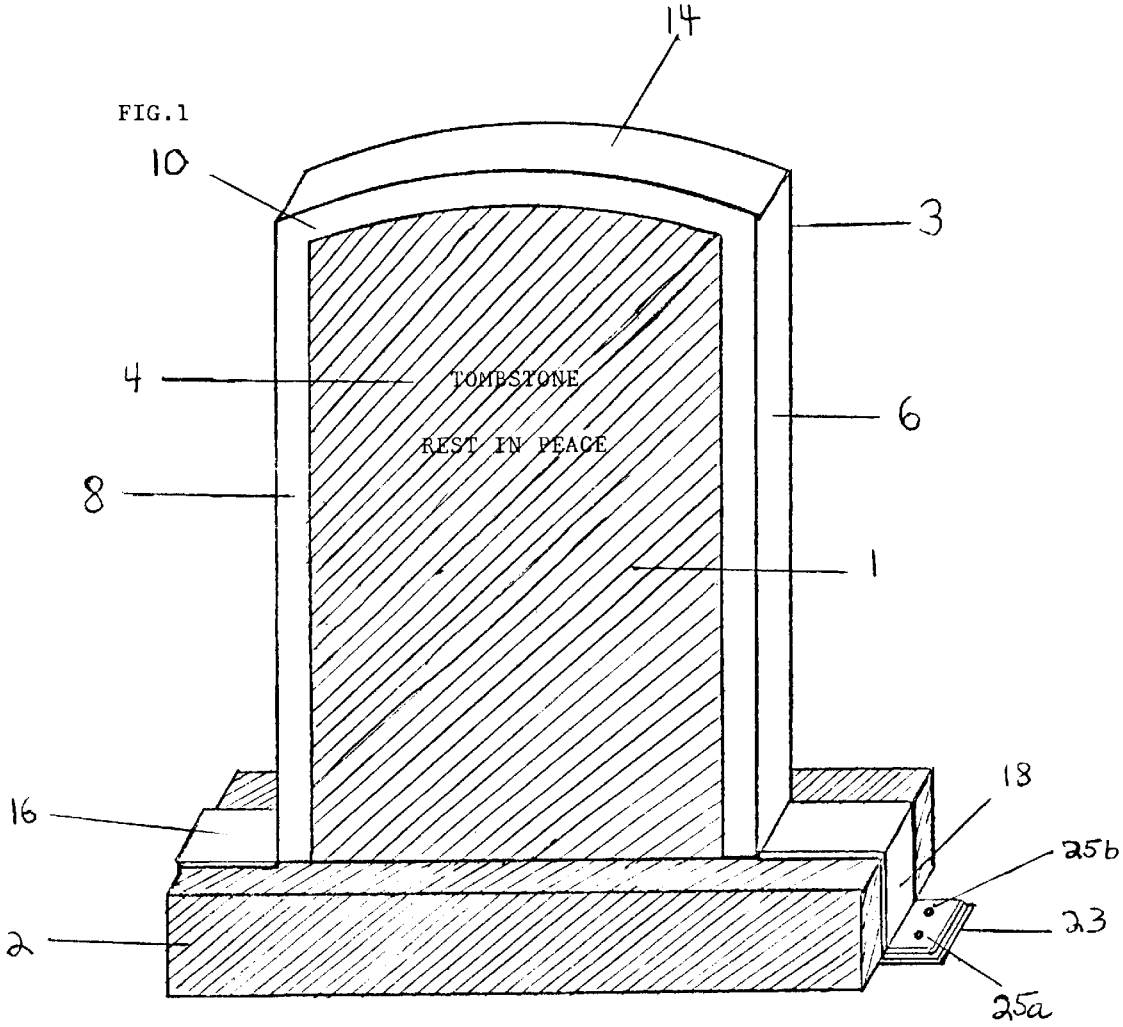
FIG. 1 is a perspective view of a repaired tombstone as per the invention.
Figure 2:
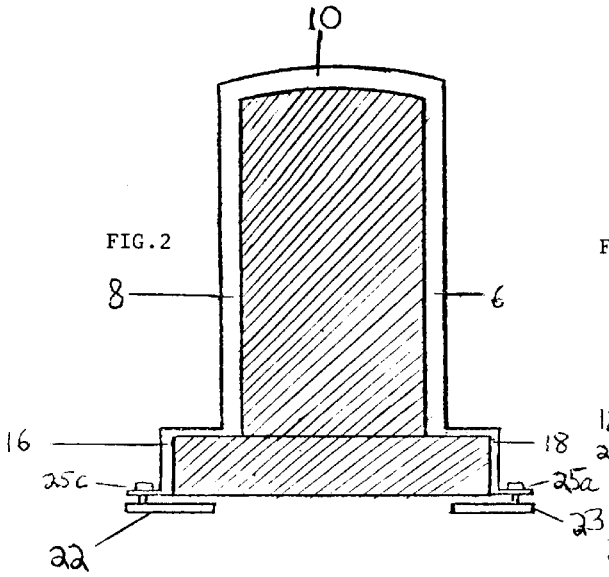
FIG. 2 is a front view of the repaired tombstone showing the original tombstone with the inscription area left visible.
Figure 3:
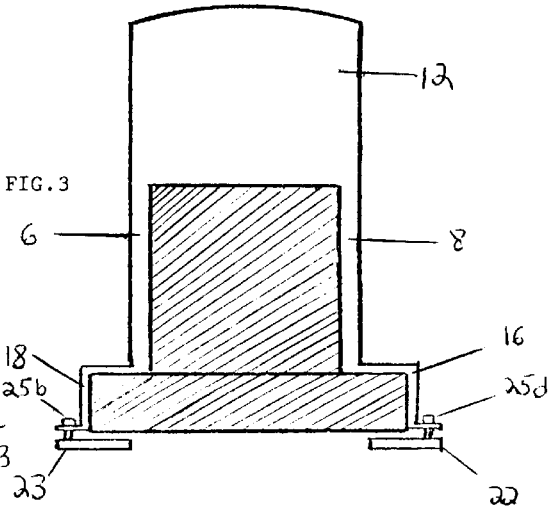
FIG. 3 is a back view of the repaired tombstone showing the integrated plate where the original inscription will be engraved.
Figure 4:
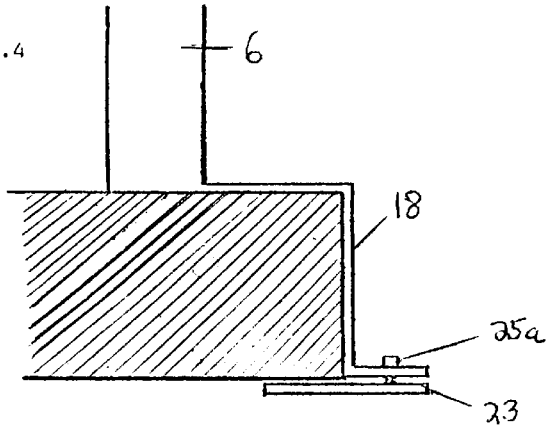
FIG. 4 is an enlarged view from the front of the repaired tombstone focusing on the right side keeper plate as it hooks under the concrete base making the stainless frame a permanent part of the tombstone.
Figure 5:
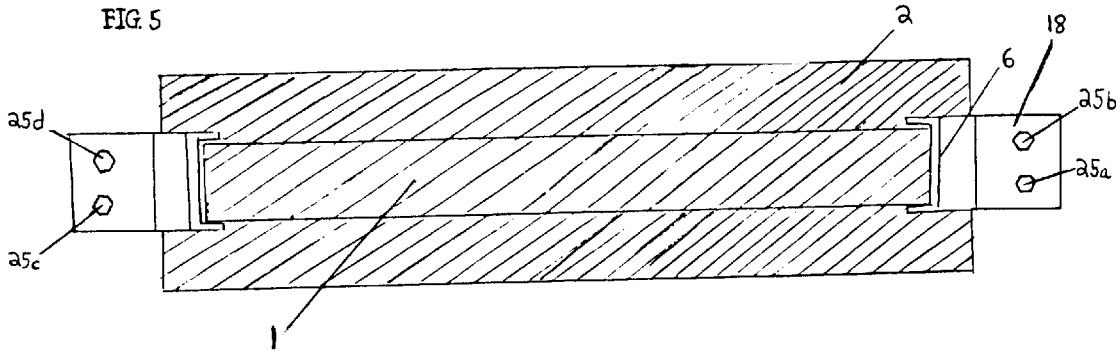
FIG. 5 is an enlarged cross-sectional view from the top of the repaired tombstone focusing on the top of the keeper plate showing the placement of the screws fastening the keeper plate to the stainless frame.

1 Tombstone
2 Base
3 Frame
4 Original inscription on front of tombstone
6 Right side of frame
8 Left side of frame
10 Top front of frame
12 Back of frame
14 Top of frame
16 Left top part of keeper plate
18 Right top part of keeper plate
20*a*, 20*b* Drilled holes in right top part of keeper plate
22 Left bottom part of keeper plate
23 Right bottom part of keeper plate
25*a*, 25*b*, 25*c*, 25*d* Screws

DETAILED DESCRIPTION OF THE INVENTION

The invention is a device which in its preferred embodiment comprises (a) a stainless steel frame 3 that minimally encloses the outside edges of a broken but reassembled or unbroken historical tombstone 1, (b) an integrated back panel 12 large enough to permit an engraved copy of the original inscription 4 appearing on the front side of the tombstone 1 to be repeated (but not shown) on the back side of the tombstone 1, (c) stainless steel keeper plates (18 combined with 23 and 16 combined with 22) that form the base of the frame 3 and hook under the concrete base 2 from the sides of the tombstone 1 below ground level and (d) a layer of silicone between the tombstone 1 and the stainless steel frame 3 to protect the stone 1 during periods of expansion and contraction. The front of the frame 3 is left open sufficiently to permit the original inscription 4, however worn, to be seen. The completed frame 3 is capable of preserving permanently the original historical tombstone 1 along with the original inscription 4 that may have faded due to the wear and tear of age and weather.

Tombstones suitable for repair using the present invention are generally box shaped with six substantially rectangular parts or sides, namely a top, a bottom, a front, a back, a right and a left when facing the front of the tombstone. The top can be flat or rounded. When standing upright the tombstones usually present a larger surface area on the front and back compared to the other sides and are taller than they are wide. The frame of the present invention minimally encloses the edges with a one inch overlap formed where the parts or sides meet except for the edges where the bottom side meets the front, back and side panels. The edges formed by the right and left and bottom sides are enclosed by resting the tombstone 1 on the base 2 and fastening the keeper plates 16,18 to the right and left sides 6,8 of the frame 3.

The preferred stainless steel frame 3 is made from a sheet of no less than 11 ga stainless steel stock. The stainless steel is cut on a shear into strips of sufficient height or length (slightly longer than the length of the right and left sides of the stone 1) and width to wrap around the edges formed where the front and back sides meet the right and left sides of the stone 1. The stainless steel is bent into a channel form to wrap around the right front and left back edges of the stone by a minimum of about one inch and leave a gap of about one sixteenth of an inch between the stainless steel and the stone 1. This gap is provided to accommodate a silicone or equivalent adhesive and form a cushion between the stainless steel and the stone 1 to permit expansion and contraction due to weather changes.

Where necessary to copy any arches or rounding at the top of the stone 1, the front portion 10 of the frame 3 for the top of the tombstone 1 is formed by using a CNC milling machine. The strip must also be wide enough to provide an overlap of the front top edge of the stone 1 to match the one-inch overlap of both sides of the frame 3. A minimum overlap of about one inch is preferred albeit all that is required is for sufficient overlap to fix the frame 3 firmly to the tombstone 1.

The back portion 12 of the frame 3 is made from a sheet of the same stainless steel. The same arch(s) or rounding, if present, is milled onto the top of this portion, as was done for the top front portion of the frame 3. The back portion 12 of the frame 3 must also maintain the one sixteenth of an inch gap between the frame 3 and the stone 1 as the other portions of the frame 3. The back portion of the frame 3 preferably extends down from the top of the stone 1 about one third of the height of the stone 1 being repaired. This size is preferred to match the usual location of the original inscription 4 on the front of the stone 1.

The engraving on the back 12 is preferably carried out using a CNC milling machine and a three eighths inch ball end mill going about fifty thousandths of an inch deep for the family name and a one quarter inch ball end mill going down about the same depth for the rest of the lettering.

One more strip for the top portion 14 of the frame 3 is preferably cut to such length and width both to maintain the one-sixteenth inch gap between the stone 1 and other portions of the frame 3 and to connect to the portions of the frame covering the front, back, right and left sides of the stone and (where not already provided for rounded top as indicated above) overlap the top front edge of the stone by about one inch. This strip is hand formed to match any arch(s) or rounding at the top of the stone 1.

The main parts of the frame 3 are now complete and can be welded together preferably using a TIG welder. While welding the parts of the frame 3 together the preferred one sixteenth inch gap between the frame 3 and stone 1 must still be maintained at all points. The frame 3 is now fitted over the stone 1 to check for size, the bottoms of the side channels 6,8 thus formed are then cut to a length which permits the frame 3 to rest flush on the top side of the concrete base 2.

Two more strips of stainless for the top parts of the keeper plates 16,18 are cut to the same width as the side channels 6,8 and are hand formed to follow the contour of the top and right and left sides of the concrete base 2, following the base 2 below ground level preferably extending to a point about one quarter inch above the bottom side of the base 2, and then bent ninety degrees away from the sides of the base 2 terminating about two inches away from the base 2. Preferably two eleven thirty seconds of an inch holes are drilled for screws 25*a*,25*b*,25*c*,25*d* about one inch apart centered on the terminal ninety degree bent pieces of the top part of the keeper plates 16,18 about one inch from the ends. Two more pieces 22,23 of stainless steel of the same width, about four inches long, are cut. Two holes one inch apart centered on these plates 22,23 are drilled and tapped one inch from one end preferably for five sixteenths of an inch, twenty four threads per inch stainless screws 25*a*,25*b*,25*c*,25*d* so that, when assembled, the four inch pieces 22,23 will hook under the concrete base 2 to complete the keeper plate. This structure will effectively make the stainless frame 3 a permanent part of the original tombstone 1 connected to the base 2.

When the frame 3 is completed to this point a small hole must be dug at each end of the concrete base 2 to allow for the keeper plates 22,23 to be installed. One hundred percent silicone is then applied between the broken parts of the tombstone 1, if any, and the broken parts of the stone 1 are fitted together. More silicone is applied to the inside of the stainless steel frame 3 and to the mating parts of the outside of the tombstone 1. The stainless frame 3 is then slid over the tombstone 1 and the keeper plates 22,23 are screwed on. The holes dug by the concrete base 2 are filled and the repair of the stone 1 is now complete.

This process can also be used to preserve newer relatively unspoiled stones at a lower cost than stone replacement would require although the process was originally designed for historical tombstones which have already deteriorated from the ravages of time.

The various parts of the frame 3 can be reduced in size and thickness so that only the edges of the stone are covered preferably with a one-inch overlap on each side of all but the bottom edges. All that is required is that the parts of the frame 3 are firmly fastened together and are capable of holding the tombstone 1 together firmly for an indefinite period of time. Thicker tombstones are most suitable for use of frames that overlap the edges by as little as one inch. When completed the frame becomes a unitary structure permanently integrated with the upright tombstone sitting on its base in a cemetery.

The products disclosed herein represent preferred embodiments of the invention. Many other variations are possible but are too numerous to disclose in their entirety. The words and drawings used and disclosed herein are merely descriptive and illustrative and are not intended as exact representations of, or inflexible limitations on, the spirit and scope of the invention disclosed herein. The invention can only be measured by the legally valid scope of any claims eventually issued in a subsequent patent.

I claim:

1. A combination of a frame affixed to a tombstone wherein the frame has sufficient strength and rigidity to repair and extend indefinitely the life of a broken or intact tombstone sitting on a base comprising;

(1) a tombstone and a base to which the frame is bonded both the tombstone and the base having box-like substantially rectangular shapes with six substantially rectangular sides further comprising, (a) a top, a bottom, a front, a back, a right and a left side when facing the front side of the tombstone with the bottom side of the tombstone sitting on the top side of the base, (b) twelve corresponding edges where the six sides connect to each other further comprising a front top, a front bottom, a right front, a left front, a top back, a bottom back, a right back, a left back, a top right, a bottom right, a top left and a bottom left edge and (c) a portion of the top and bottom sides and the front and back sides of the base extend beyond the right, left, front and back sides of the tombstone and (2) a frame (a) sized to fit over and enclose all but the bottom edges of the tombstone, (b) including a plate covering enough of the back of the tombstone to reproduce any inscription found on the front of the tombstone, (c) open enough on the front side of the tombstone to expose the original inscription on the front side of the tombstone and (d) extending beyond the right and left sides of the tombstone and wrapping around the portions of the base that extend beyond the right and left sides of the tombstone.

2. The frame of claim 1 in which the combination is a unitary structure permanently bonded to a tombstone sitting on a base.

3. The frame of claim 2 in which the combination is a unitary structure permanently bonded to a broken tombstone in which the broken pieces are mended together with adhesive before the frame is attached to the tombstone.

4. The frame of claim 1 in which the combination is made of stainless steel.

5. The frame of claim 1 in which the combination is affixed to a tombstone by a layer of silicone adhesive to cushion and protect the assembled frame and tombstone from expansion and contraction due to weathering.

6. The combination of claim 1 in which the integrated back panel bears an engraving of the original inscription thus preserving the original inscription on the front side of the tombstone that may have faded over time.

7. The combination of claim 1 in which the frame is bonded to the tombstone sitting on a base wherein (a) the frame is sized and shaped to fully enclose the right, left and top sides of the tombstone overlapping the top front, right front, left front, right back and left back edges by a minimum of about one inch leaving the front side of the tombstone largely exposed so the original inscription is fully exposed and overlapping the top back edge enough to accommodate a legible engraving of an original inscription appearing on the front of the tombstone and (b) the portions of the frame that attach the tombstone to the base comprise a first and a second piece fastened together wherein the first piece extends along the top side of the base away from both the right and left side of the tombstone, bends to continue down both the connecting right and left side of the base to a point about one quarter inch above the bottom side of the base, bends again at about a ninety degree angle and ends two inches away from both the right and left sides of the base and the connecting second piece is about the same width as the first piece and is long enough to extend far enough under the bottom side of the base below ground level making the frame a permanent part of the tombstone sitting on its base.

8. The combination and tombstone of claim 7 wherein the space between the frame and the tombstone is about one sixteenth of an inch and is filled with silicone adhesive to protect the frame and tombstone from the expansion and contraction caused by weathering.

9. The combination of claim 7 wherein the portion of the frame covering the back side of the tombstone bears an engraving of the original inscription on the front side of the tombstone thus preserving the inscription that may have faded over time.

10. The combination and tombstone of claim 7 in which the top side of the tombstone is rounded and the top of the frame is fitted to the rounded top side of the tombstone and comprises three pieces which are fastened together wherein (a) the first piece is cut to match the rounded top front edge of the tombstone and extend down from the top front edge of the tombstone by about one inch, (b) the second piece for the back of the frame is also cut to match the rounded top back edge of the tombstone and extend down the back side of the tombstone about one third of the distance from the top back edge to the bottom back edge of the tombstone and (c) the third piece is sized and shaped to fill the space on the rounded top side of the tombstone between the first and second pieces, is then fitted to the top side of the tombstone and finally affixed to the other parts of the frame located below the top edges of the tombstone leaving a sufficient gap between the frame and tombstone to accommodate an adhesive.

11. A method for repairing and/or preserving tombstones sitting on a base wherein (a) the tombstone and the base are box-like structures with six substantially rectangular sides comprising a front, a back, a top, a bottom, a right and a left side when facing the front side and eight corresponding edges where the sides meet comprising a front top, a front bottom, a right front, a left front, a top back, a bottom back, a right back, a left back, a top right, a bottom right, a left top and a left bottom edge (b) the top side of the base extends beyond the right and left sides of the tombstone, and (c) the front of the tombstone bears an inscription, which method comprises encapsulating the tombstone with an integrated frame which minimally covers the top, right and left edges overlapping the edges by a minimum of about one inch using a material having sufficient strength and durability to preserve the tombstone indefinitely and continues to hook over the portions of top, bottom, right, and left sides of the base which extend beyond the right and left sides of the tombstone sufficiently to securely fasten the tombstone and frame to the base.

12. The method of claim 11 wherein the frame completely covers the top, right and left sides and a minimum of the upper third of the back side of the tombstone with a reproduction of the inscription on the front side of the tombstone engraved on the portion of the frame covering the upper third of the back side of the tombstone.

13. The method of claim 12 wherein the material used for the frame is stainless steel, the frame is sized to leave a space of about one-sixteenth of an inch between the frame and the tombstone, and the space is filled with a silicone adhesive to allow for expansion and contraction due to weather changes.

14. The method of claim 12 wherein the tombstone is broken into two or more pieces and the pieces are fastened together using an adhesive before fitting the frame over the tombstone.

* * * * *